United States Patent [19]

Schultz

[11] Patent Number: 4,726,386

[45] Date of Patent: Feb. 23, 1988

[54] BRUSH FLUID APPLICATOR AND METHOD OF MAKING THE SAME

[75] Inventor: Robert S. Schultz, Old Greenwich, Conn.

[73] Assignee: Emson Research Inc., Bridgeport, Conn.

[21] Appl. No.: 848,151

[22] Filed: Apr. 4, 1986

[51] Int. Cl.[4] ..... A45D 40/00; B43M 11/06

[52] U.S. Cl. ..... 132/79 B; 401/189

[58] Field of Search ..... 132/79 A, 79 B, 88.7, 132/79 R; 401/186, 187, 183, 102

[56] References Cited

U.S. PATENT DOCUMENTS 3,655,290 4/1972 Griffith ..... 401/186

3,896,822 7/1975 Zimmerman ..... 132/79 B

*Primary Examiner*—Robert Peshock

*Attorney, Agent, or Firm*—Alfred E. Miller

[57] ABSTRACT

A liquid nail polish applicator having a bottle containing a supply of nail polish and a brush applicator on the open end of the bottle. The brush is supplied with nail polish liquid internally through the brush bottle upon the removal of the center seal from the open end of the bottle and upon inverting the bottle.

8 Claims, 20 Drawing Figures

3
10
16
3
9
18
22
9
8
28
57
8
29
7
32
7
40
6
34a
6
34
38
5
36
5
10
12
14
20
16

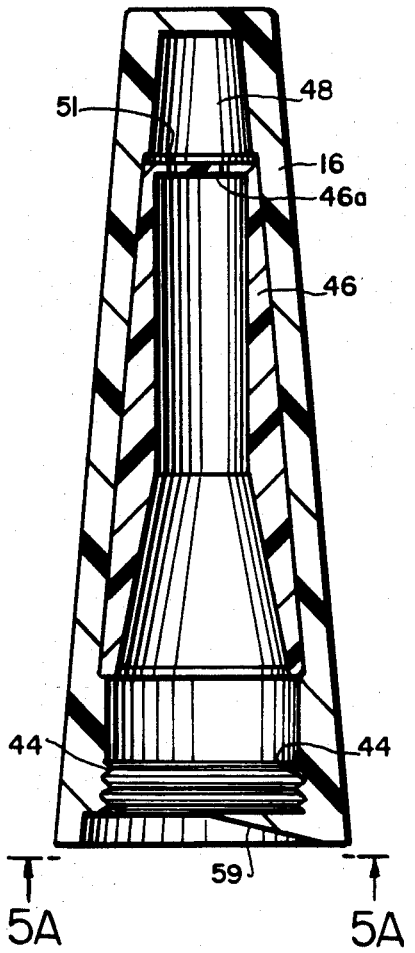
FIG.5
FIG.6A
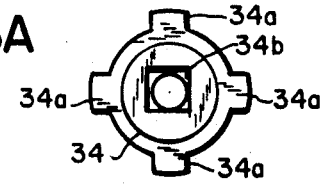
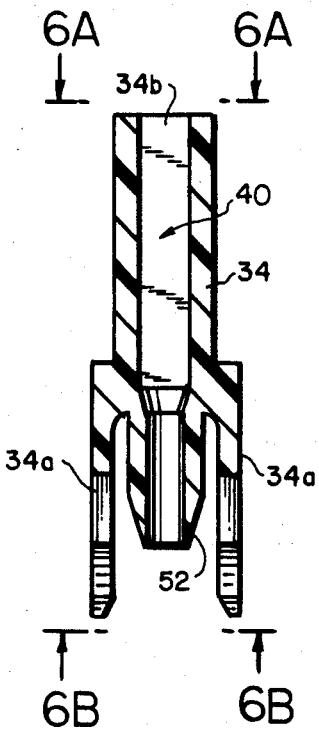
FIG.6
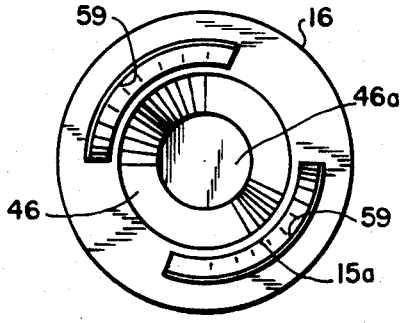
FIG.5A
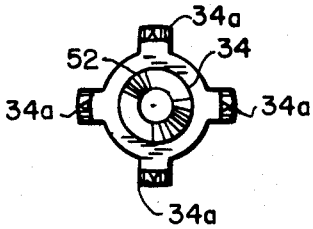
FIG.6B

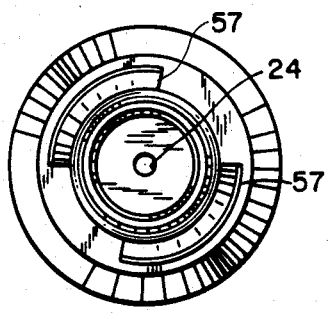
FIG.8A
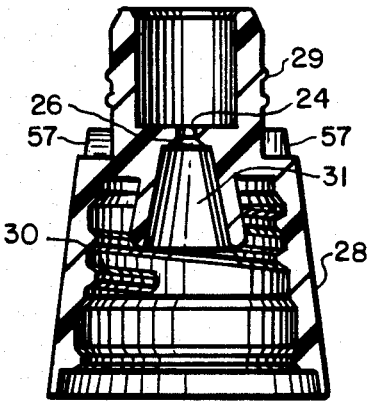
FIG.8
FIG.8B
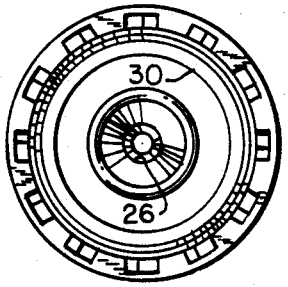
FIG.7
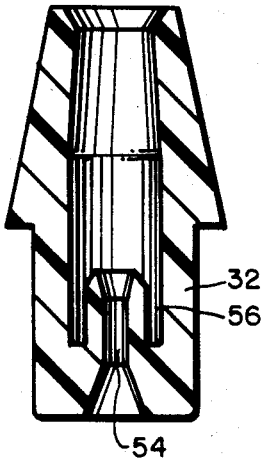
FIG.9
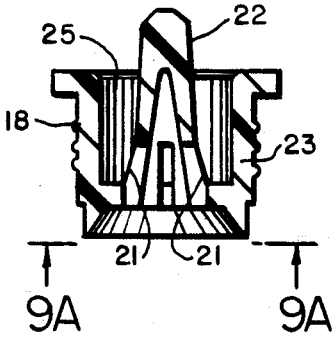
FIG.9A
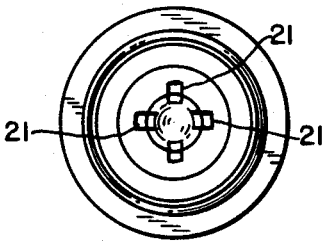

BRUSH FLUID APPLICATOR AND METHOD OF MAKING THE SAME

The present invention relates to a fluid applicator, and more particularly to a liquid finger nail polish dispenser having a bottle or reservoir for containing a supply of polish, and a small bristle brush to be held in a cap, or other closure device, for the bottle or reservoir, said brush being supplied with nail polish liquid centrally and internally upon removal of the center seal from the feed port and inverting the bottle.

Many prior art arrangements have been devised in order to protect the brush of the nail polish device or applicator against hardening of the polish material thereon between periods of use, however, little success has been achieved in those endeavors.

It is the object of the present invention to provide a liquid applicator or dispenser for nail polish or the like provided with both an inner cap and an overcap, a finger nail brush in a chamber, and an internal space between said inner cap and overcap having a solvent, and a portion of said inner cap being provided with a wall surface for controlled diffusion of said solvent therethrough to the chamber housing said brush.

It is the further object of the invention to provide a nail polish applicator having a bottle or tube with said liquid therein and a center seal member in the mouth of said container and a bottle cap for said container provided with an opening therethrough, said brush being arranged in a brush holder whereby the nail polish is fed substantially centrally through said opening and said brush bristles, and said center seal is adapted to close said opening in said bottle cap upon the movement of said bottle cap in the direction of said bottle.

The present invention is also directed to the novel method of making a nail brush in which the brush braid is fed continuously to a brush anchor and cut at predetermined lengths, and the fibers may be split to form a braided brush together with the brush anchor, both of which are inserted and fixed within the brush holder.

It is thus an object of my invention to provide a brush together with a brush anchor that is inserted in the brush holder. The aforesaid structure is inserted within the bottle cap, the latter being screw connected to the neck of a bottle or tube of nail polish. The bottle or tube is provided with an insert having an upstanding center seal for sealing off the opening in the bottle cap when it is desired not to permit the passage of liquid nail polish through the opening thereof, and, consequently, through the center of the brush bristles.

The overcap is provided with an inner cap that seals over the bottle cap.

FIG. 5 is a view taken along 5—5 of FIG. 2.

FIG. 5*a* is a bottom elevational view taken along the lines 5*a*—5*a* of FIG. 5.

FIG. 6 is a sectional view taken along the lines 6—6 of FIG. 6.

FIG. 6*a* is a top plan view taken along the lines 6*a*—6*a* of FIG. 6.

FIG. 6*b* is a bottom plan view taken along the lines 6*b*—6*b* of FIG. 6.

Figures 1, 2:
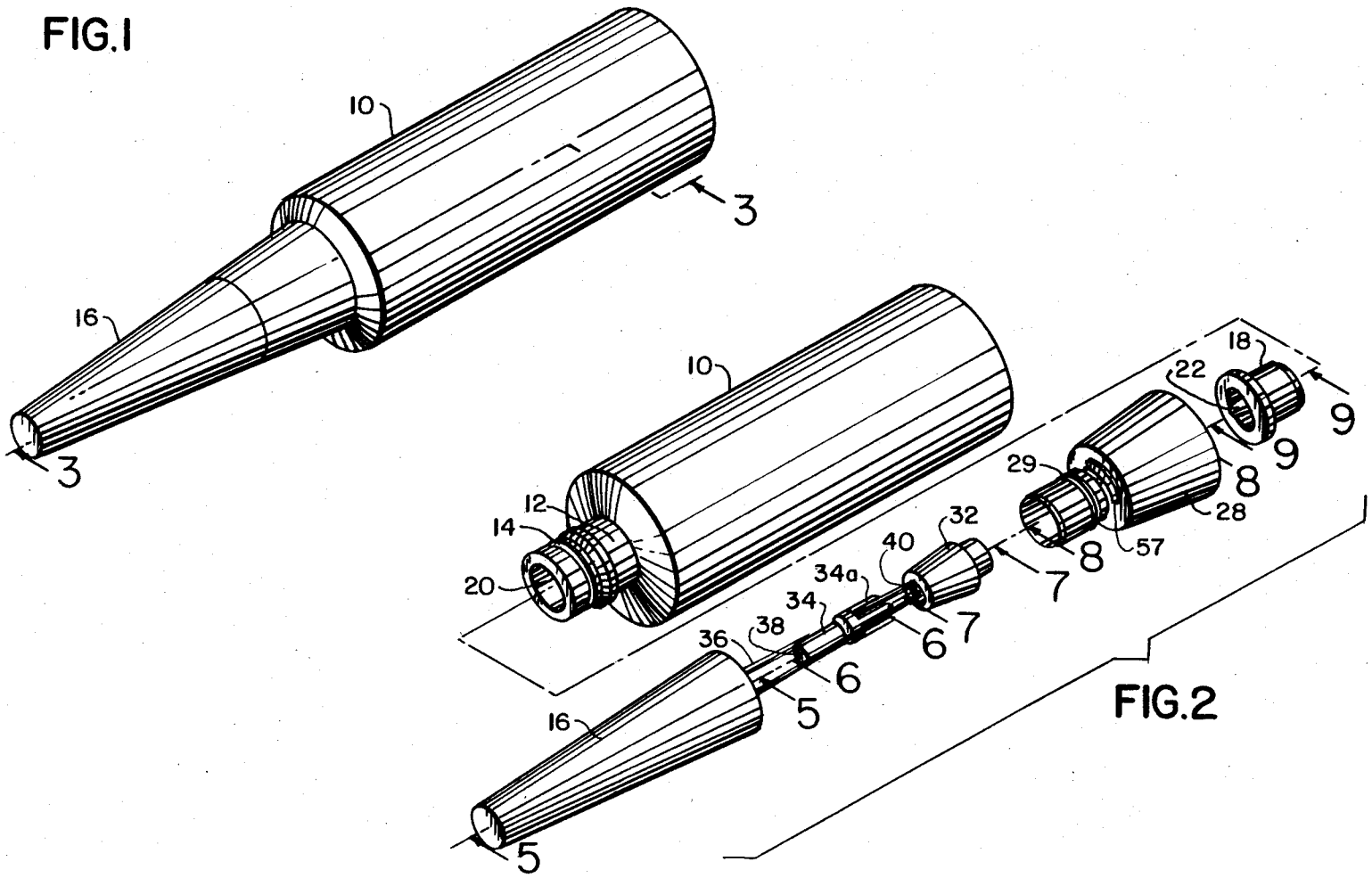
FIG. 1 is a perspective view of the liquid nail polish brush applicator in its closed condition, constructed in accordance with the teachings of my invention.
FIG. 2 is an exploded view of the liquid nail polish applicator shown in FIG. 1 in which all the essential parts thereof are shown.

FIG. 7 is a side elevational view taken along the lines 7—7 of FIG. 1.

FIG. 8 is a sectional view taken along the lines 8—8 of FIG. 2.

FIG. 8*a* is a view taken along the lines 8*a*—8*a* of FIG. 8.

FIG. 8*b* is a view taken along the lines 8*b*—8*b* of FIG. 8.

FIG. 9 is a sectional view taken along the lines of 9—9 of FIG. 2, while

FIG. 9*a* is a bottom plan view taken along the lines 9*a*—9*a* of FIG. 9.

Figure 10:
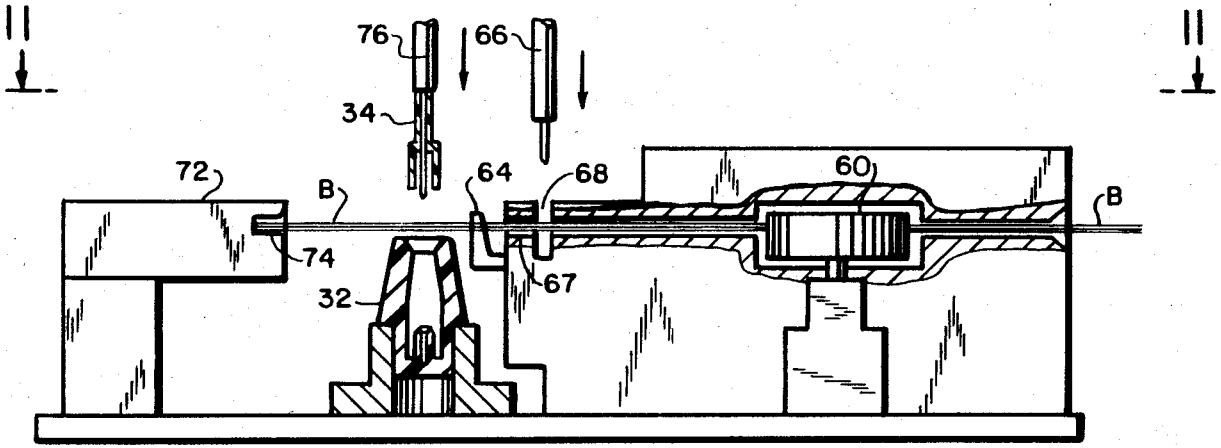

FIG. 10 is a schematic view of the assembly and method of fabricating a brush for use with a nail pen.

Figure 11:
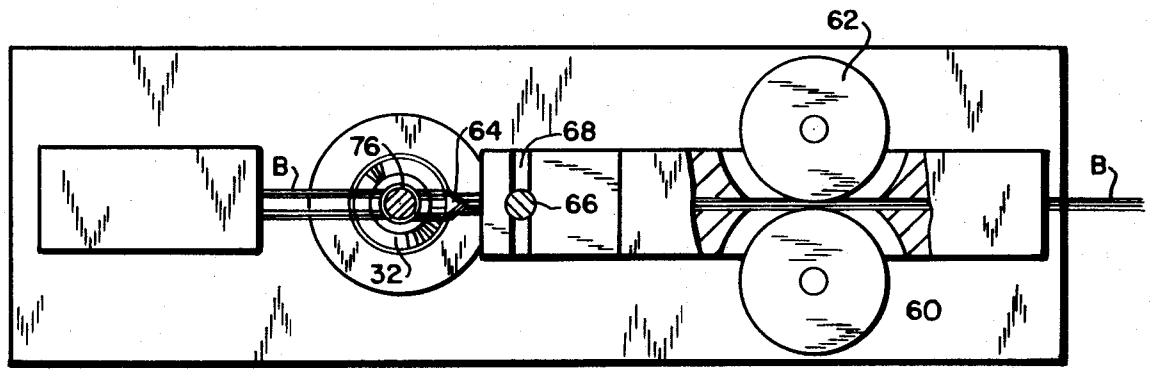

FIG. 11 is a top plan view of the assembly for fabricating a brush for a nail polish applicator constructed in accordance with the present invention and taken along the lines 11—11 of FIG. 10.

Figure 12:
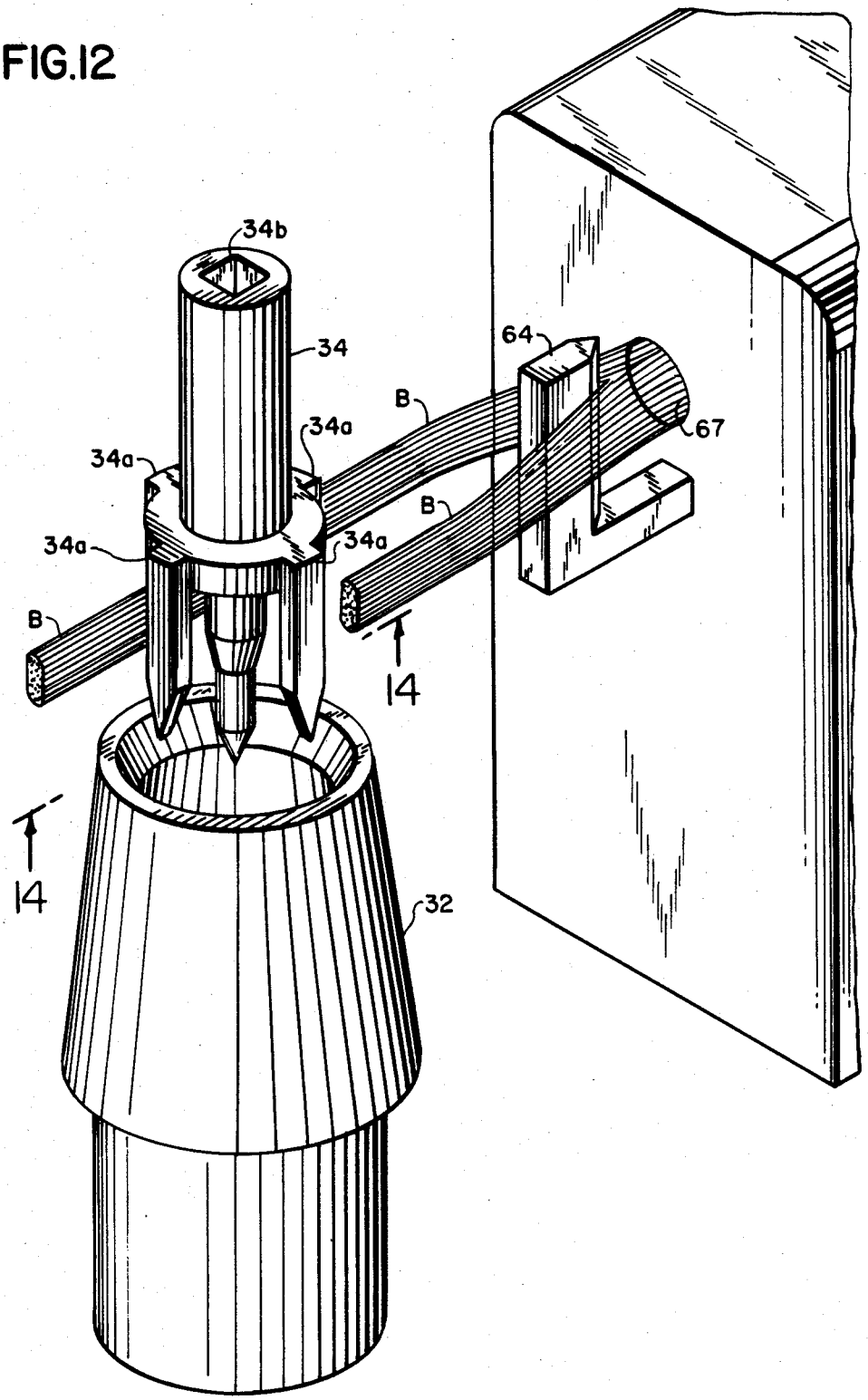

FIG. 12 is a perspective view of the brush fibers being acted upon by a splitter and fed into the brush anchor for insertion within said brush holder.

Figure 13:
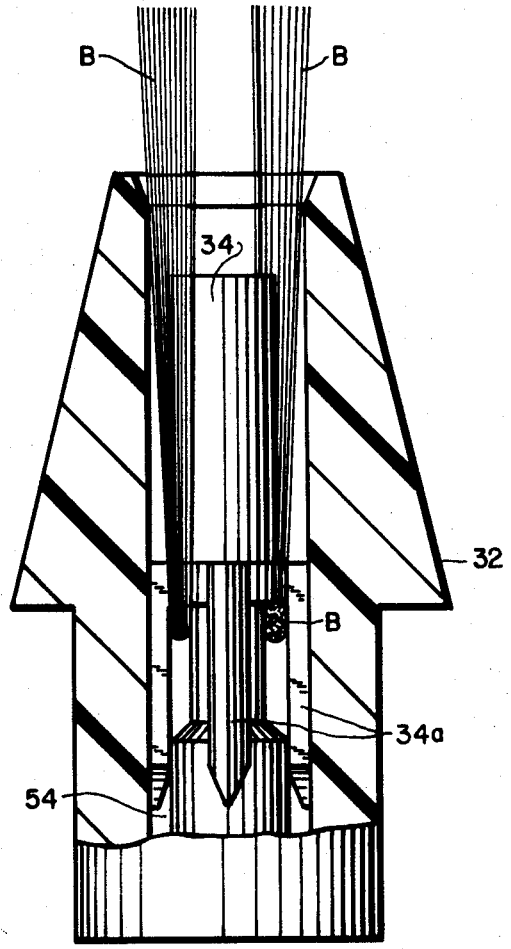

FIG. 13 is an enlarged partial sectional view and partial elevational view of the assembled brush anchor and brush holder.

Figure 14:
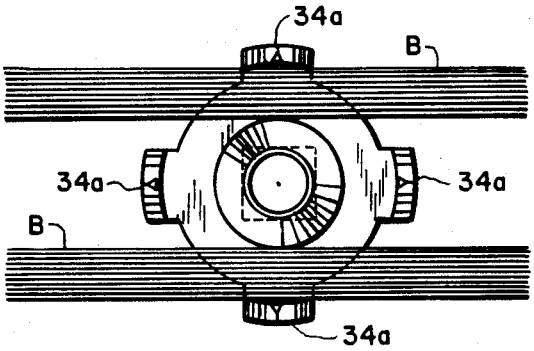

FIG. 14 is a view taken along lines 14—14 of FIG. 12 showing a top plan view of the brush braids within the legs of the brush anchor for entrapping said braids therein.

Referring particularly to FIGS. 1 and 2, the nail polish fluid applicator constructed in accordance with the teachings of the present invention comprises a bottle or tube 10 having an open end neck portion 12 provided with external screw threads 14. An overcap 16 is shown in the closed position in FIG. 1 and removed or separated from the device in FIG. 2.

Figure 3:
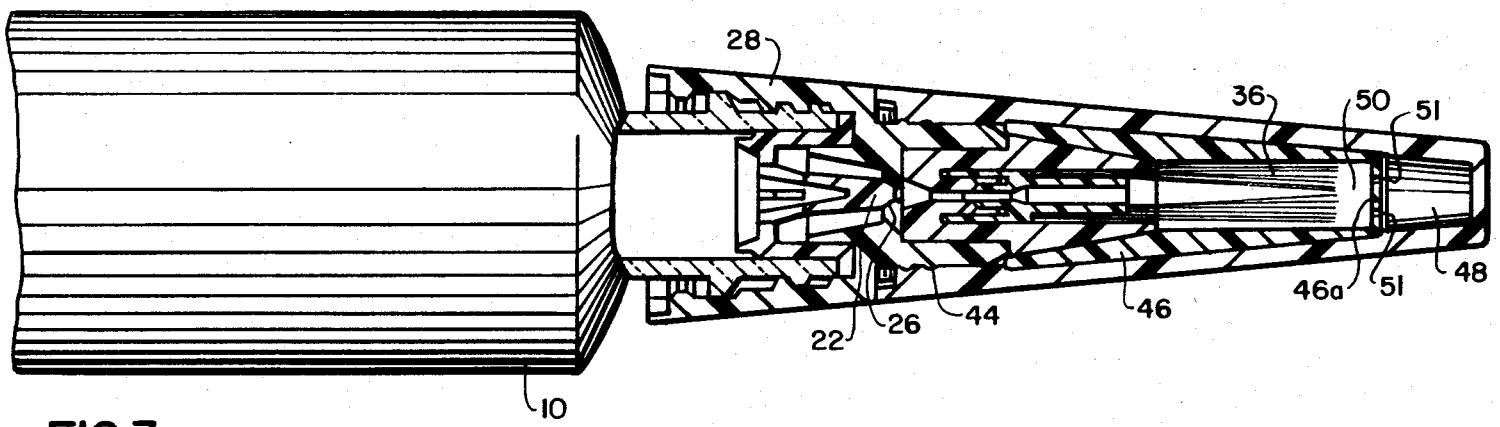
FIG. 3 is a cross sectional view taken along lines 3—3 of FIG. 1 showing the liquid nail polish applicator in its closed position with its cap in place.
Figure 4:
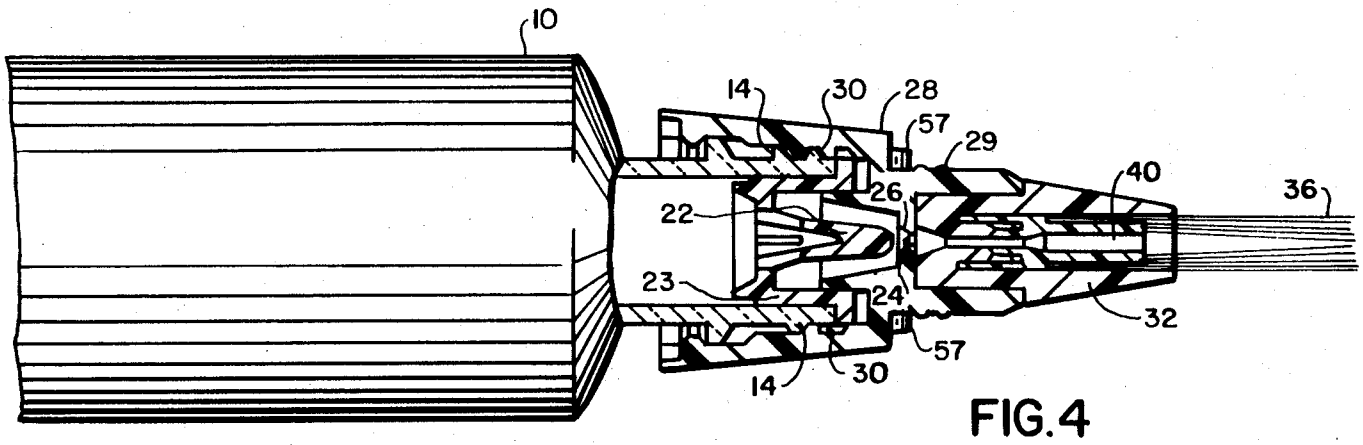
FIG. 4 is a cross sectional view of the liquid nail applicator with brush, with the overcap removed and the bottle cap unscrewed to its open position.

FIG. 2 shows the exploded view of the principle elements of the fluid applicator device which includes a centrally disposed projecting center seal 18 which is designed to fit within the opening 20 of the bottle 10, as seen in FIG. 3, and the center seal is provided with a center sealing post 22 which is adapted to close and seal opening 24 by means of the end of the center post 22 being inserted within hole or aperture 24 and engaging the seat 26 of the hole 24, as seen in FIG. 3. The center post 22 is fabricated of a plastic material, such as polyethylene. The bottle cap 28 is provided with internal screw threads 30 which engage the threads 14 of the bottle or tube 10. The center seal 18 is also provided with an integral U-shaped member 23 which covers the opening of the bottle 10 and seals the same, as seen in FIGS. 3 and 4, and additionally functions as a barrier to the liquid product preventing leakage of liquid out of the neck portion 12 of the tube 10, and not permitting the flow of the liquid in the bottle 10 to the bristles of the brush in a manner hereinafter described. A brush holder 32 for insertion within the bottle cap is seen in FIGS. 3 and 4, said brush holder being fabricated, for example, of polyethylene. A brush anchor 34, which may be fabricated of a plastic material, such as Celcon, is seen in FIG. 2 having a plurality of spaced legs 34*a*. Entrapped by the legs 34*a* and the innere wall of brush holder 32 are intermediate portions of a plurality of brush bristles 36. Thus, the bristles 36 are arranged in an upstanding manner relative to the bottle 10. It should be noted from the Figures that the brush anchor 34 is provided with a central opening 40 that extends along the longitudinal axis of the brush anchor 34. This opening 40 permits the center feed of nail polish liquid from the bottle 10 sequentially through the opening 24 in the bottle cap opening 54 in brush holder, opening or channel 40 in the brush anchor, and hence through center of brush bristles, when the openings are not blocked by the center post 22 of the center seal.

In order to prevent the nail polish liquid from hardening in the container and on the bristles of the brush 36 the applicator device is provided with an overcap 42, having a plurality of thread indentations 44, which frictionally engage and mate with a plurality of threads 29 on the bottle cap 28. In addition, the overcap is provided with an inner cap 46 having a wall 46*a* which is permeable to a solvent S housed in chamber 48 between the inner and outer caps. Thus, the wall 46*a* is so designed and constructed as to control the diffusion of the solvent therethrough into the lower chamber 50 housing the brush bristles of the nail polish applicator brush, plus solvent may be in the form of a sponge (not shown) and upper wall 46*a* may have one or more small holes 51 therein for controlled diffusion.

FIG. 5 shows a cross section of the overcap member 16 in which thread indentations 44 are located at the open end thereof and are adapted to engage with the threads 29 of the bottle cap 28. As previously stated, the overcap 16 additionally has an inner cap 46 having a thin upper wall 46*a* which is permeable to the housing chamber 48 provided with a solvent therein.

The brush anchor 34 is provided with a plurality of legs 34*a* arranged concentrically about a centrally disposed truncated conically topped tube 52 as well as an opening 53 throughout the axial length.

FIG. 6*a* is a top view of the brush anchor 34 while FIG. 6*b* is a bottom view thereof. The brush anchor 34 is additionally provided with an opening or channel 34*b*, as shown in FIG. 6.

The brush guide and cap seal 32 is shown in FIG. 7 which shows a through channel 54 for the passage of liquid therethrough and is provided with an annular groove 56 for receiving the legs 34*a* as well as a portion of the brush bristles. The channel 54 of the cap seal 32 is adapted to receive the truncated conically topped tube 52 of the brush anchor 34.

The bottle cap 28 is more particularly shown in FIGS. 8, 8*a* and 8*b* in which the shoulder is provided with release ramps 57 as seen in greater detail in FIGS. 8 and 8A. The overcap 16 has a pair of mating ramps 59, as seen in FIGS. 5 and 5A which engage the respective ramps 57 when the overcap is screwed on the bottle cap and brush holder 28.

FIGS. 9 and 9*a* are views showing the center sealing post 22 with its center seal 18 and the integral U-shaped member 23. As seen in the figures, four liquid ports 21 are shown through which the liquid nail polish flows to a liquid storage compartment or reservoir 25 and which is blocked from flowing to the brush B only when the sealing post 18 is seated on the seat 26 of the hole 24.

The present liquid nail polish applicator is put in use by removing the overcap 16 with its inner cap and seal, thus exposing the bristles of the nail polish applicator brush. By turning the bottle cap 28 in the proper direction, the hole 24 is uncovered, as seen in FIG. 4, thereby permitting passage of the nail polish liquid from bottle when the bottle 10 is inverted and/or squeezed, nail polish, or the like, flows through the liquid ports 21. liquid storage compartment 25, and the opening and passages 24, 54 and 34*b*, to the center of the brush B. thereby permitting the application of the nail polish liquid, as desired.

The method of making the present brush fluid applicator is shown in FIGS. 10–14. As seen in FIGS. 10 and 11 the drive wheel 60 rotates in a counter-clockwise direction against wheel 62 with the brush strands B which are continuously fed between the wheels and through a splitter 64. It should be noted that in some instances a splitter device may not be necessary, and therefore this element may be eliminated from the process, however, a cutter 66 reciprocates into and out of engagement with the brush strands and cuts said strands in groove 68 of the apparatus. The free end of the brush strands engage in groove 74 of stop member 72. In this manner both cut ends of the brush strands are held in place since the opposite cut end of the brush strands are held in groove 67. Thereafter, inserter 76 which holds the brush anchor 34 is driven downwardly with the legs 34*a* and center post 52 into engagement with the center portion of the cut strip of brush strands B and engages the brush strands as shown in FIG. 12 between the legs 34*a* and the center post 52 of the brush anchor 34. Furthermore, as seen in FIGS. 13 and 14, as the brush anchor 34 is driven downwardly by the inserter, with the brush lengths or strands entrapped between the legs 34*a* and the center post 52, the brush anchor is frictionally inserted within the brush holder 32, thus securing the same therein, while the free ends of the brush strands or bristles are directed to project out of the brush guide to thereby extend freely therefrom to form the brush element for the liquid finger nail polish dispenser.

While the invention has been disclosed and described herein with reference to a certain embodiment, it is apparent that variations and modifications may be made which will fall within the true spirit and scope of the invention as defined in the following claims.

I claim:

1. A brush fluid applicator assembly for nail polish or the like comprising a hollow body receptacle adapted to contain fluid and having an open end, a cap for said open end having at least one port therein, a plug for said open end having a projecting sealing post, a brush holder provided with a passageway for said fluid, a brush anchor for functionally securing a plurality of brush lengths in combination with said brush holder, said brush anchor being provided with a channel, whereby when said cap and brush holder are turned in one direction the sealing post blocks said passageway to prevent the movement of fluid therethrough, and when said cap and brush holder is turned in the opposite direction the sealing post is removed from said passageway thereby permitting fluid to flow by gravity or pressure from said fluid storage compartment through said port in said cap, said passageway and channel and internally and substantially centrally through the bristles of said brush lengths.

2. A brush fluid applicator assembly as claimed in claim 1 further comprising an overcap for said applicator provided with an inner cap having a solvent permeable wall.

3. A brush fluid applicator as claimed in claim 1 wherein said brush holder is provided with an internal groove, and said brush anchor has a plurality of legs for holding portions of said brush lengths in said groove while the ends of said brush lengths protrude freely from said brush holder.

4. A brush fluid applicator as claimed in claim 3 wherein said brush anchor is provided with a hollow center post surrounded by said legs circumferentially, and said brush lengths being positioned and held between said legs and center post.

5. A brush fluid applicator as claimed in claim 1 wherein said cap and brush holder assembly is screw-connected to said hollow body receptacle and the end thereof remote from said receptacle is provided with a recess for securely holding said brush holder.

6. A brush assembly for a nail polish bottle or the like including a removable cap comprising a brush guide provided with a central passageway and an annular groove surrounding at least a part of said passageway said brush guide being mounted in said cap, a brush anchor provided with a plurality of legs, and a central passageway through, and a plurality of brush lengths having a median portion thereof entrapped between said legs, and secured in said brush holder upon insertion of said brush anchor in said passageway with said legs and said median portions of the brush lengths being located in said annular groove, while the free ends of said brush lengths project out of said brush guide.

7. A brush assembly for nail polish or the like as claimed in claim 9 wherein said brush guide and brush anchor are both fabricated of a plastic material.

8. A brush fluid applicator as claimed in claim 3 further comprising a space formed between said inner cap and overcap and having a solvent therein, and wherein said solvent permeable wall in said inner cap is provided with at least one hole for transfer of said solvent from said space to the free ends of said brush lengths.

* * * * *